US005230472A

United States Patent [19]

McCabe

[11] Patent Number: 5,230,472

[45] Date of Patent: Jul. 27, 1993

[54] SHOWER ROSE ASSEMBLY

[76] Inventor: Stephen C. McCabe, 9 Augusta Street, Glenhuntly, VIC 3163, Australia

[21] Appl. No.: 915,407

[22] Filed: Jul. 20, 1992

Related U.S. Application Data

[63] Continuation of Ser. No. 566,387, Aug. 22, 1990, filed as PCT/AU89/00483, Aug. 22, 1990, abandoned.

[30] Foreign Application Priority Data

Oct. 10, 1988 [AU] Australia ..... PJ1385

[51] Int. Cl.[5] ..... B05B 1/18; B05B 15/08

[52] U.S. Cl. ..... 239/443; 239/553.3; 239/556; 239/587.2; 239/587.5

[58] Field of Search ..... 239/553.3, 565, 566, 239/557, 556, 444, 443, 590.3, 587.2, 587.5; 4/601

[56] References Cited

U.S. PATENT DOCUMENTS

| | | | |
|---|---|---|---|
| 166,212 | 8/1875 | Maqueen | 239/558 |
| 368,938 | 8/1887 | Foley | 239/553 |
| 1,102,736 | 7/1914 | Grabad | 4/601 X |
| 1,525,237 | 2/1925 | Hilfiker | 4/601 X |
| 1,583,068 | 5/1926 | Nelson | 239/558 X |
| 1,981,976 | 11/1934 | Wem | 239/567 X |
| 2,124,551 | 7/1938 | Friedman et al. | 239/567 X |
| 2,288,590 | 7/1942 | McClure et al. | 239/556 |
| 2,299,259 | 10/1942 | Sites | 239/587.5 X |
| 2,481,074 | 9/1949 | Brown | 239/573 X |
| 2,520,770 | 1/1945 | Manville et al. | 239/553.5 |
| 2,663,178 | 12/1953 | Schwartz | 239/558 X |
| 2,716,914 | 9/1955 | Pigott | 239/444 X |
| 3,241,772 | 3/1966 | Thompson | 239/587.2 X |
| 3,415,259 | 12/1968 | Noren et al. | 239/556 X |
| 3,602,436 | 8/1971 | Wright | 239/590.3 X |
| 3,913,829 | 10/1975 | Wilson | 239/444 X |
| 3,921,914 | 11/1975 | Hatt | 239/567 |
| 4,600,153 | 7/1986 | Stone | 239/556 X |

FOREIGN PATENT DOCUMENTS

| | | |
|---|---|---|
| 1111087 | 10/1981 | Canada . |
| 134318 | 1/1966 | New Zealand . |
| 138344 | 3/1966 | New Zealand . |
| 154021 | 4/1971 | New Zealand . |
| 155087 | 3/1972 | New Zealand . |
| 175095 | 3/1978 | New Zealand . |

*Primary Examiner*—Andres Kashnikow
*Assistant Examiner*—Kevin Weldon
*Attorney, Agent, or Firm*—Larson and Taylor

[57] ABSTRACT

A shower rose or head assembly includes a supply device (16) and a pair of shower roses or heads (10). Each head includes a chamber into which water can be supplied from a common water supply via the supply device, and at least one wall through which a plurality of outlet apertures (38) are provided and from which water can issue from the chamber in a plurality of narrow streams. A valve assembly (28) is also provided serving to close off the supply of water to the shower head (11). The chamber of each shower head has an internal cross-sectional dimension smaller than for a conventional shower head thus providing a constriction in the flow path through the assembly, whilst the supply device contains a branch conduit (17) which serves to provide a further constriction in the flow path through the assembly. The constrictions serve to reduce the rate of flow of water through the assembly.

14 Claims, 2 Drawing Sheets

SHOWER ROSE ASSEMBLY

This application is a continuation of application Ser. No. 07/566,387 filed Aug. 22, 1990, filed as PCT/AU89/00483, Aug. 22, 1990, now abandoned.

TECHNICAL FIELD

This invention relates to a shower rose or head assembly, and more particularly, to a shower rose assembly where water issues from a chamber having a wall through which an array of outlet apertures is provided from which the water can issue from the chamber in a plurality of narrow streams.

BACKGROUND ART

Water authorities are ever increasingly encouraging conservation of water supplies as populations expand and the demand for water increases. One course of action adopted is the imposition of standards as to the maximum volume of water to pass through a shower system in a given period of time, which most systems using conventional shower roses or heads exceed and thus cannot achieve the required standard.

It is therefor a primary object of the present invention to provide a shower rose assembly which reduces the volume of water passing through the assembly but maintains a relatively high water pressure in the spray and a high spray area.

There is also a need for such shower systems in situations where two or more persons may wish to shower together in the same shower enclosure for reasons of water conservation, or other reasons, or in clubs or institutions, where a plurality of shower roses are connected to a single inlet and a number of persons shower at the same time. The invention is also applicable to circumstances where the quantity of hot water available at any one time may be limited and thus water for showering needs to be conserved if a relatively large number of persons, such as a large family, or a sporting team, all need to shower over a time span in which the supply of hot water is likely to be exhausted and a relatively long time is necessary to generate replacement hot water at the supply, and which time delay may be inconvenient. To date there are no shower systems known to me that meet these needs.

DISCLOSURE OF THE INVENTION

The invention therefore envisages a shower rose or head assembly comprising a supply means, and a shower rose or head defining a chamber, into which water is supplied from a water supply via said supply means, and having at least one wall through which a plurality of outlet apertures are provided and from which water can issue from said chamber in a plurality of narrow streams, wherein said assembly incorporates a constriction in at least part of the flow path through the assembly whereby the rate of flow of water passing through the assembly is reduced.

In one embodiment of the invention at least part of the internal cross-sectional dimension of the chamber is smaller than for a conventional shower rose thus providing said constriction.

Preferably the thickness of said shower rose is in the order of 2 mm to 10 mm, as compared with a conventional shower rose thickness of in the order of 30 mm.

Alternatively, or in addition, the supply means in the assembly contains a constricted portion.

Preferably said shower rose assembly includes a plurality of shower roses to which water can be selectively delivered and from each of which, depending on the selection, water can issue through the respective outlet apertures.

Preferably the chambers defined by said shower roses may be incorporated in the one shower rose body with one or more partitions therein to separate said chambers.

Alternatively, each said chamber may be defined by its own shower rose body and all said chambers are connected to a common water supply.

It has been found that with a significantly thinner shower rose body, and therefore smaller internal chamber dimension to form a constriction in the flow path through the assembly, or by providing a constricted portion in the supply passage, water flowing through the assembly is reduced but water pressure is maintained in the system to cause a relatively strong stream of water to issue from the shower rose or roses. In circumstances where a plurality of roses are supplied by a common water supply and are in connection therewith, the water still issues from each rose in relatively powerful and continuous streams than would be the case if two or more conventional sized roses were combined in a single assembly, where it would be normal for the chamber most remote from the common water supply to receive a significantly lesser amount of water so as to produce inadequate streams of water at relatively low pressure. Such may even result in a stream pattern which is not constant, as would be demonstrated by controlling water supply to a conventional shower rose to a relatively small volume where the water issuing from each outlet aperture runs together with that from the other apertures across the face of the shower rose to combine and fall as a single stream rather than separate narrow relatively powerful streams.

DESCRIPTION OF THE DRAWINGS

One preferred embodiment of the invention will now be described with reference to the accompanying drawings, in which.

BEST MODE FOR CARRYING OUT THE INVENTION

Figure 1:
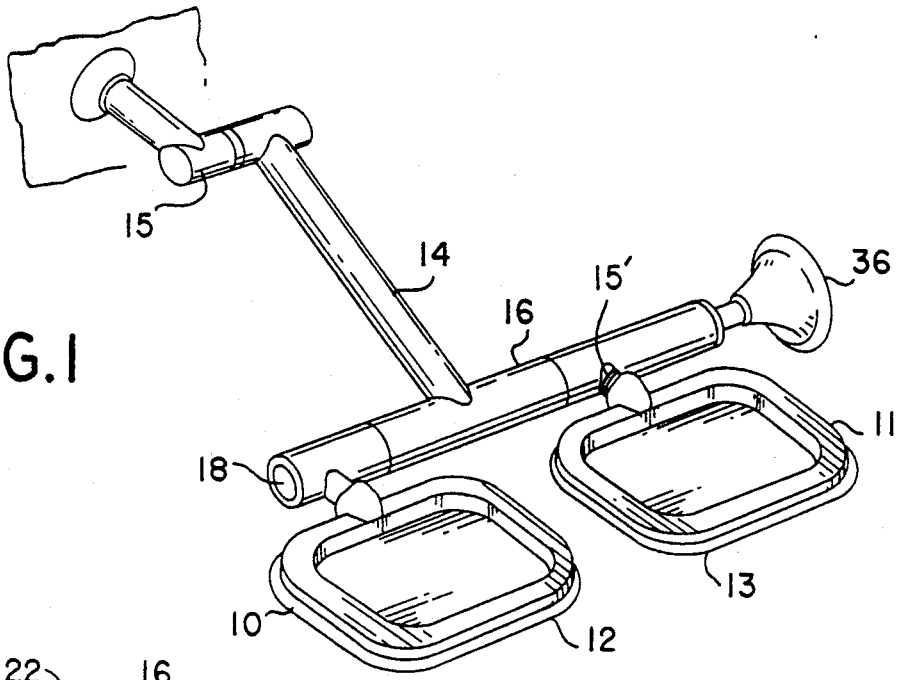
FIG. 1 is a perspective view from above of an embodiment of the invention incorporating a pair of shower roses, forming a double shower rose coupled to a common water supply.

Referring to the FIGURES of the drawings, a double shower rose or head assembly is illustrated comprising a pair of shower roses 10 and 11 defined by separate shower rose bodies, each body defining a chamber and having a substantially flat wall 12 and 13 through which outlet apertures 38 are formed and from which water supplied to said chambers would issue in a plurality of continuous narrow streams. In this embodiment of the invention water is supplied to the shower roses 11 through a supply conduit 14 connected to a water supply provided at an adjacent wall and incorporating a pivot joint 15 at the wall to allow the angle of the shower rose arrangement to be adjusted vertically as for conventional shower roses. The supply conduit 14 communicates with the interior of a diverter/valve housing 16 containing a co-axial branch conduit 17 extending to one end of the housing and supported in sealing engagement with an end closure member 18 threadably received within that end of the housing. The branch conduit 17, in turn, passes through spaced apart partition members 19 and 20 which in effect separate the interior of the housing into a supply chamber 21 communicating with the supply conduit 14, a delivery chamber 22 for one of the shower roses (shower rose 10) and a valve chamber 23 associated with the other shower rose 11. The delivery chamber 22 has an outlet port 24 feeding the interior of the shower rose 10, whilst the valve chamber 23 has an outlet port 35 feeding the interior of the other shower rose 11. The branch conduit 17 has a pair of diametrically aligned apertures 26 through which water in the supply chamber 21 can pass into the branch conduit 17. The branch conduit has a further pair of diametrically aligned apertures 27 communicating with the interior of the delivery chamber 22 for the shower rose 10, and it will be apparent that, with conventional hot and cold water controlling taps associated with the shower arrangement and supplying water to the supply conduit 14, water will be supplied continuously, via supply chamber 21, apertures 26, branch conduit 17 (which constricts the flow of water), apertures 27, delivery chamber 22 and outlet port 24, to shower rose 10.

Figure 2:
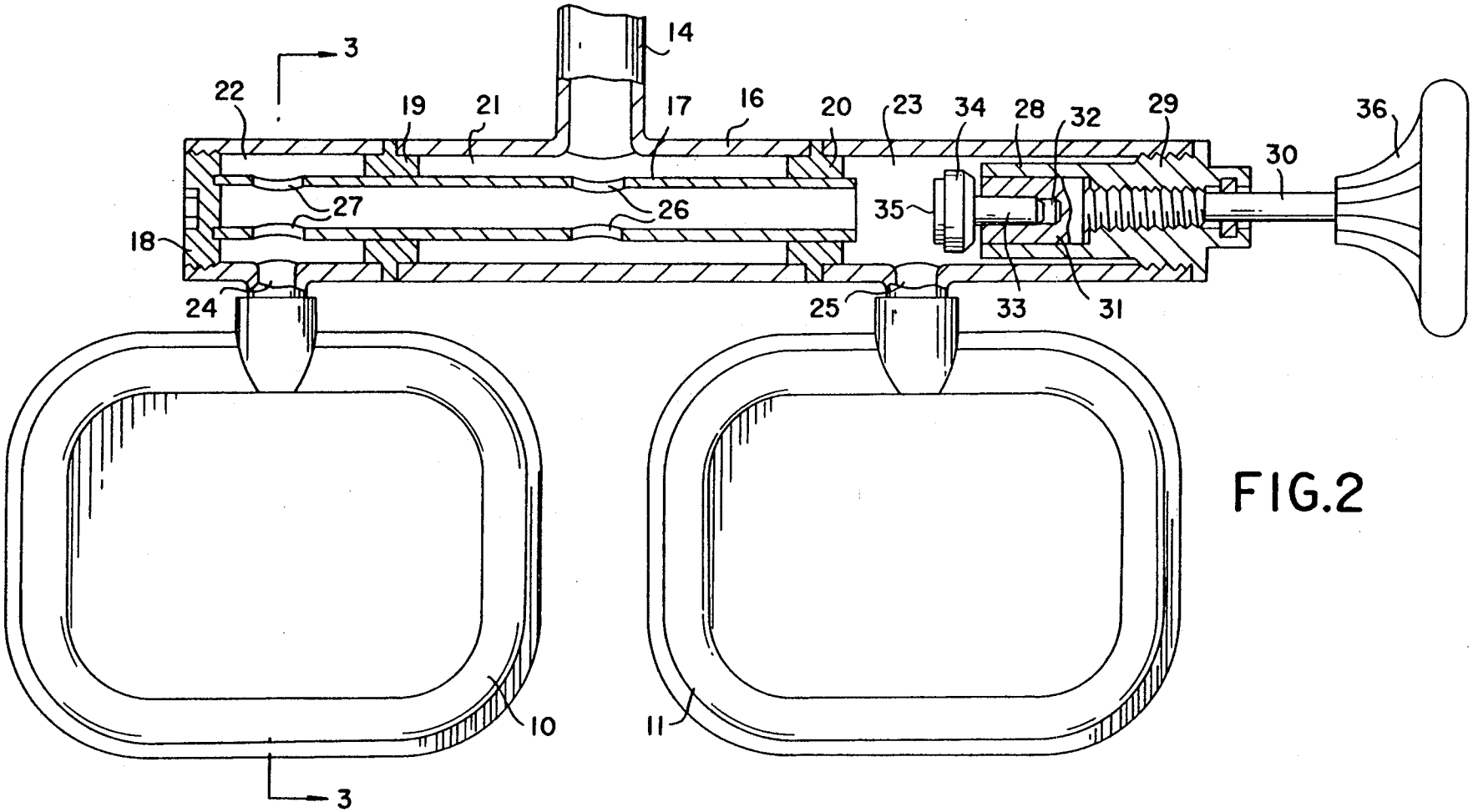
FIG. 2 is a plan view partly sectional of the shower rose assembly of FIG. 1.

The end of the branch conduit 17 passing through partition member 20 and into valve chamber 23, is open to chamber 23 and forms a valve seat for co-operation with a valve assembly 28. The valve assembly 28 consists of a stuffing box 29 threadably received within the associated end of the housing 16 and through which an externally threaded spindle 30, co-operating with an internally threaded axial bore through the stuffing box and operable by a handle 36, passes. The inner end of the spindle 30 carries a valve support member 31 having an axial blind hole 32 in the inner end thereof which receives the stem 33 of a non-return valve 34 carrying a sealing washer 35. The non-return valve is axially moveable to automatically move axially towards the valve seat formed by the end of the branch conduit 17 to close the end of the conduit when water pressure downstream of the valve chamber 23 exceeds the supply pressure. With the valve in the position shown in FIG. 2 water can enter the valve chamber 23, via the conduit 17 which constricts the flow of water, and then through the outlet port 25 to the shower rose 11, but when the valve spindle is screwed fully inwardly the sealing washer 35 of the non-return valve 34 will seat on the valve seat provided by the end of the conduit 17, to prevent water entering the valve chamber 23 and from there entering the shower rose 11. In such circumstances only shower rose 10 will be operable. By moving the valve 34 progressively further away from the valve seat, progressively greater volumes of water will be allowed to enter the valve chamber 23 and onto the shower rose 11.

The connections between the outlet ports 24 and 25 and their associated shower roses 10 and 11 may be pivotable connections to allow the angles of the two shower roses to be adjusted. Such a pivotal connection is shown by pivot joint 15' in FIG. 1.

Figure 3:
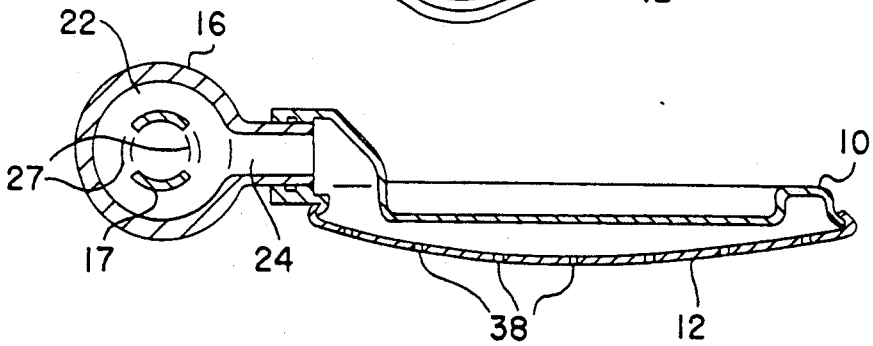
FIG. 3 is a cross-sectional view taken along line 3—3 of FIG. 2.

As will be evident from FIG. 3 of the drawings, the thickness of the bodies for each shower rose is relatively small compared with the conventional shower rose and may be as small as 2 mm, or as large as 10 mm, but preferably in the order of 5 mm or less. The peripheries of the shower rose bodies are of larger size defining a larger portion for their internal chambers to accommodate attachment of connecting conduits of conventional diameter through which the ports 24 and 25 extend, but the size of the chambers very rapidly narrows to the relatively small size required for the remainder of the shower roses.

Figure 4:
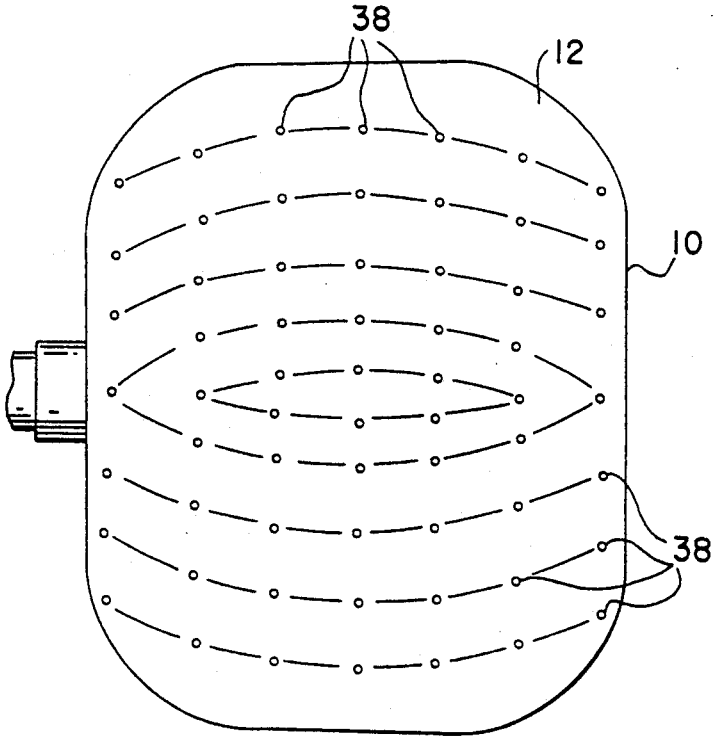
FIG. 4 is a underneath view of one of the shower roses forming the assembly of this embodiment.

As shown in. FIG. 4, the outlet apertures 38 in the shower, roses may lie on a series of arcs, and may amount to 62 apertures in each rose, for an overall total of 124 apertures compared with a conventional rose which normally has 133 outlet apertures.

As referred to previously, where a single rose in accordance with the invention is provided, or only rose 10 in this embodiment of invention is operative, there is a saving in water due to the smaller thickness of the shower rose which causes a build-up of water pressure within the rose, and the streams of water issuing are still relatively strong. When the water supply is also supplied to the second shower rose 11, in the case of the preferred embodiment of the invention when the valve assembly 28 is open, the excess water pressure in shower rose 10 allows flow of water to shower rose 11 and a satisfactory shower pressure is achieved in both shower roses.

I claim:

1. A shower head assembly comprising:

a supply means having an outlet port with a cross-sectional flow area for conducting water from a water supply in a shower to said outlet port thereof;

at least one shower head attached to said outlet port of said supply means including an elongate chamber adjacent said outlet port and extending along a longitudinal axis, said elongate chamber having a cross-sectional flow area greater than the cross-sectional flow area of said outlet port.

a pair of substantially flat walls which are mounted so as to be superimposed and separated from one another to define a) a discrete discharge chamber therebetween into which water from said elongate chamber is supplied along a flow path perpendicular to the longitudinal axis of said elongate chamber and b) an internal cross-sectional flow area of the flow path parallel to the longitudinal axis of said elongate chamber between said discharge chamber and said elongate chamber, said internal cross-sectional flow area being sized to form a constriction means for reducing a rate of flow of water to said discharge chamber from the water passing freely from said outlet port of said supply means and into said elongate chamber and hence for reducing the flow of water through said supply means, and a plurality of outlet apertures in one of said walls from which water issues in a plurality of narrow streams from said discharge chamber.

2. A shower head assembly as claimed in claim 1 wherein a separation distance of said flat walls from one another at said cross-sectional flow area is between 2 mm and 10 mm.

3. A shower head assembly as claimed in claim 1 wherein said supply means contains a second constriction means for reducing a rate of flow of water passing through said supply means from the water supply.

4. A shower head assembly as claimed in claim 1 and further including a second outlet port of said supply means and a second shower head which is connected to said second outlet port such that water from said supply means is deliverable to said second shower head.

5. A shower head assembly as claimed in claim 4 wherein said second shower head is substantially identical to said first-mentioned said shower head.

6. A shower head assembly as claimed in claim 5 wherein said supply means includes a valve means for selectively isolating said second shower head from the water supply.

7. A shower head assembly as claimed in claim 1 wherein said supply means includes a first pivot means for mounting said outlet port for pivotal movement relative to the water supply and about a horizontal axis; and wherein said shower head further includes a second pivot means for mounting said elongate chamber for pivotal movement relative to said outlet port and about an axis perpendicular to a horizontal axis parallel to the first-mentioned horizontal axis; whereby the direction of the narrow streams is selectable by pivoting movement of said first and second pivot means.

8. A shower head assembly comprising:

a supply means for conducting water from a water supply in a shower, said supply means including a proximal portion rigidly mounted in a fixed position to a vertical wall of the shower, a distal portion including an outlet port with a cross-sectional flow area through which the water from the water supply flows, and a first pivot joint means for joining said proximal portion and said distal portion fluidly together and for mounting said distal portion including said outlet port for pivotal movement relative to said proximal portion and about a horizontal axis; and at least one shower head including an elongate chamber adjacent said outlet port and extending along a longitudinal axis, a second pivot joint means for joining said outlet port and said elongate chamber fluidly together and for mounting said elongated chamber for pivotal movement relative to said outlet port and about an axis perpendicular to a horizontal axis parallel to the first-mentioned horizontal axis, a pair of substantially flat walls which are mounted so as to be superimposed and separated from one another to define a discrete discharge chamber therebetween into which water from said elongated chamber is supplied along a flow path perpendicular to the longitudinal axis of said elongate chamber, and a plurality of outlet apertures in one of said walls from which water issues in a plurality of narrow streams from said discharge chamber with the direction of the narrow streams being selectable by pivoting movement of said first and second pivot joint means.

9. A shower head assembly as claimed in claim 8 wherein a separation distance of said flat walls from one another at said cross-sectional flow area is between 2 mm and 10 mm.

10. A shower head assembly as claimed in claim 8 wherein said supply means further includes a second constriction means for reducing a rate of flow of water passing through said supply means from the water supply.

11. A shower head assembly as claimed in claim 8 and further including a second outlet port of said supply means and a second shower head which is connected to said second outlet port such that water from said supply means is deliverable to said second shower head.

12. A shower head assembly as claimed in claim 11 wherein said second shower head is substantially identical to said first-mentioned said shower head.

13. A shower head assembly as claimed in claim 12 wherein said supply means includes a valve for selectively isolating said second shower head from the water supply.

14. A shower head assembly as claimed in claim 8 wherein said elongate chamber has a cross-sectional flow area greater than the cross-sectional flow area of said outlet port; and wherein said flat walls also define an internal cross-sectional flow area of the flow path parallel to the longitudinal axis of said elongate chamber between said discharge chamber and said elongate chamber, said internal cross-sectional flow area being sized to form a constriction means for reducing a rate of flow of water to said discharge chamber from the water passing freely from said outlet port of said supply means and into said elongate chamber and hence for reducing the flow of water through said supply means.

* * * * *